US011064843B1

(12) United States Patent
Swartz

(10) Patent No.: US 11,064,843 B1
(45) Date of Patent: Jul. 20, 2021

(54) PROTECTIVE MOBILE HAND WASH STATION

(71) Applicant: Personal Protected, LLC, New Middletown, OH (US)

(72) Inventor: Jeffrey Mark Swartz, New Middletown, OH (US)

(73) Assignee: PERSONAL PROTECTED, LLC., New Middletown, OH (US)

( * ) Notice: Subject to any disclaimer, the term of this patent is extended or adjusted under 35 U.S.C. 154(b) by 0 days.

(21) Appl. No.: 17/217,372

(22) Filed: Mar. 30, 2021

Related U.S. Application Data

(63) Continuation of application No. 17/134,974, filed on Dec. 28, 2020.

(60) Provisional application No. 63/016,398, filed on Apr. 28, 2020.

(51) Int. Cl.
*A47K 1/02* (2006.01)
*A47K 5/12* (2006.01)
*A47K 10/00* (2006.01)

(52) U.S. Cl.
CPC ..... *A47K 1/02* (2013.01); *A47K 5/12* (2013.01); *A47K 10/00* (2013.01)

(58) Field of Classification Search
CPC ..... A47K 1/02; A47K 5/12; A47K 10/00
USPC .... 4/620, 625, 626, 628, 630, 639–640, 664
See application file for complete search history.

(56) References Cited

U.S. PATENT DOCUMENTS

2010/0078904 A1* 4/2010 Collins ..... B08B 3/006 4/630
2018/0187402 A1 7/2018 Chong et al.

FOREIGN PATENT DOCUMENTS

DE 4013210 A1 10/1991
JP 2008200394 9/2008
JP 2008200394 A 9/2008

OTHER PUBLICATIONS https://www.belson.com/4-Person-Wash-Hand-Washing-Station; Screenshot of a webpage of a 4 person hand washing station; Date: Unknown; 1 Page.
https://www.youtube.comwatchv=-TV5mqEZTqqo; screenshot of a YouTube page for Soapwell by Elkay; Apr. 24, 2020; 5 pages.
https://www.umci.com/news-views/news/supporting-communities-with-touch-free-wash-stations, Apr. 8, 2020.
https://aaamobilesolutions.com/handwash-trailers/, date unknown.
https://www.elkaycommercialsystems.com/us/en/products/soapwell.html, date unknown.
Soapwell by Elkay, Touchless Hand Washing Station Model MHS2424HF Product Specification Sheet, date unknown.

* cited by examiner

*Primary Examiner* — Tuan N Nguyen
(74) *Attorney, Agent, or Firm* — Emerson Thomson Bennett

(57) ABSTRACT

A hand wash station may include at least three wash areas including sinks so users can wash their hands. Each wash area may be supported to a non-coplanar side of the hand wash station. At least one divider wall may separate the wash areas from each other to protect the users from the spread of germs. The hand wash station may be mobile in that it is designed to be easily movable from one location to another.

20 Claims, 11 Drawing Sheets

PROTECTIVE MOBILE HAND WASH STATION

This application claims priority to U.S. Ser. No. 17/134,974, titled PROTECTIVE MOBILE HAND WASH STATION, filed Dec. 28, 2020, and U.S. Ser. No. 63/016,398, titled PROTECTIVE MOBILE HAND WASH STATION, filed Apr. 28, 2020, which is incorporated herein by reference.

I. BACKGROUND

A. Field of the Invention

This invention generally relates to apparatuses and methods concerning public gatherings, social separation and hand washing.

B. Description of Related Art

The recent outbreak of the COVID-19 pandemic has magnified the importance of protecting ourselves and others from the spread of germs. By "germs" it is meant bacteria, viruses, and other microscopic particles that cause illness in humans and animals. This protection is especially important in public settings where there is exposure to many others. Thus, "social distancing"—maintaining a safe distance from others—has become a popular activity. Gas stations, supermarkets and the like have begun to install barriers between workers and members of the public. The wearing of masks by medical workers, store workers and the general public has also become a common way to provide protection.

Another critical way to provide protection from germs is proper and frequent hand washing. It is, of course, well known to provide sinks which can be used for hand washing—both privately and publicly. What is needed, however, is a public handwashing station that provides individual protection beyond what is currently available.

II. SUMMARY

According to some embodiments of this invention, a mobile hand wash station may include: a generally square cross-sectional shape having four sides defined as first, second, third and fourth non-coplanar sides; a structural frame; a first wash area supported to the structural frame and positioned on the first side; a second wash area supported to the structural frame and positioned on the second side; a third wash area supported to the structural frame and positioned on the third side; a fourth wash area supported to the structural frame and positioned on the fourth side; a first divider wall supported to the structural frame that separates the first and second wash areas from each other; a second divider wall supported to the structural frame that separates the second and third wash areas from each other; a third divider wall supported to the structural frame that separates the third and fourth wash areas from each other; a fourth divider wall supported to the structural frame that separates the fourth and first wash areas from each other; and a roof structure supported to the structural frame and defining a ceiling for each wash area. Each wash area may include: 1) a sink supported to a countertop and having: (a) a basin: and (b) a water supply implement; 2) a hand cleanser supply implement; and 3) a hand drying implement. Each divider wall may have a minimum vertical height above the corresponding countertop of at least 40 inches and a minimum width perpendicular to the vertical height of at least 30 inches. A portion of each divider wall may contact the roof structure. Each wash area may define a user location point that: 1) lies on a first plane that evenly and laterally bisects the corresponding side; 2) lies on a second plane that: (a) is parallel to the corresponding side; (b) is perpendicular to the first plane; and (c) is positioned 6 inches exterior to a perimeter of the countertop on the corresponding side; and 3) lies on a third plane that: (a) is perpendicular to the first plane; (b) is perpendicular to the second plane; and (c) is positioned vertically at 30 inches above the countertop on the corresponding side. A first line that intersects the user location point on the first side and the user location point on the second side may pass through the first divider wall. A second line that intersects the user location point on the second side and the user location point on the third side may pass through the second divider wall. A third line that intersects the user location point on the third side and the user location point on the fourth side may pass through the third divider wall. A fourth line that intersects the user location point on the first side and the user location point on the fourth side may pass through the fourth divider wall. The mobile hand wash station may be adapted to be easily movable from one location to another using wheels attached to the bottom of the mobile hand wash station.

According to some embodiments of this invention, a mobile hand wash station may include: a generally rectangular cross-sectional shape having four sides defined as first, second, third and fourth non-coplanar sides; a structural frame; a first wash area supported to the structural frame and positioned on the first side; a second wash area supported to the structural frame and positioned on the second side; a third wash area supported to the structural frame and positioned on the third side; a fourth wash area supported to the structural frame and positioned on the fourth side; a first divider wall supported to the structural frame that separates the first and second wash areas from each other; a second divider wall supported to the structural frame that separates the second and third wash areas from each other; a third divider wall supported to the structural frame that separates the third and fourth wash areas from each other; a fourth divider wall supported to the structural frame that separates the fourth and first wash areas from each other; and a light source for each wash area supported within each corresponding wash area. Each wash area may include: 1) a sink supported to a countertop and having: (a) a basin: (b) a water supply implement; 2) a hand cleanser supply implement; and 3) a hand drying implement. Each divider wall may have a minimum vertical height above the corresponding countertop of at least 40 inches and a minimum width perpendicular to the vertical height of at least 30 inches. Each wash area may define a user location point that: 1) lies on a first plane that evenly and laterally bisects the corresponding side; 2) lies on a second plane that: (a) is parallel to the corresponding side; (b) is perpendicular to the first plane; and (c) is positioned 6 inches exterior to a perimeter of the countertop on the corresponding side; and 3) lies on a third plane that: (a) is perpendicular to the first plane; (b) is perpendicular to the second plane; and (c) is positioned vertically at 30 inches above the countertop on the corresponding side. A first line that intersects the user location point on the first side and the user location point on the second side may pass through the first divider wall. A second line that intersects the user location point on the second side and the user location point on the third side may pass through the second divider wall. A third line that intersects the user location point on the third side and the user location point on the fourth side may pass through the third divider wall. A fourth line that intersects the user location point on the first side and the user location point on the fourth side may pass through the fourth divider wall. The mobile hand wash station may be adapted to be easily movable from one location to another.

According to some embodiments of this invention, a mobile hand wash station may include: a generally rectangular cross-sectional shape having four sides defined as first, second, third and fourth non-coplanar sides; a structural frame; a first wash area supported to the structural frame and positioned on the first side; a second wash area supported to the structural frame and positioned on the second side; a third wash area supported to the structural frame and positioned on the third side; a fourth wash area supported to the structural frame and positioned on the fourth side; a first divider wall supported to the structural frame that separates the first and second wash areas from each other; a second divider wall supported to the structural frame that separates the second and third wash areas from each other; a third divider wall supported to the structural frame that separates the third and fourth wash areas from each other; and a fourth divider wall supported to the structural frame that separates the fourth and first wash areas from each other. Each wash area may include: 1) a sink supported to a countertop and having: (a) a basin: and (b) a water supply implement; 2) a hand cleanser supply implement; and 3) a hand drying implement Each divider wall may have a minimum vertical height above the corresponding countertop of at least 40 inches and a minimum width perpendicular to the vertical height of at least 30 inches. The mobile hand wash station may be adapted to be easily movable from one location to another.

According to some embodiments of this invention, a hand wash station may be mobile in that it is designed to be easily movable from one location to another.

According to some embodiments of this invention, a hand wash station may be designed to be fixed in place.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION

Figure 1:
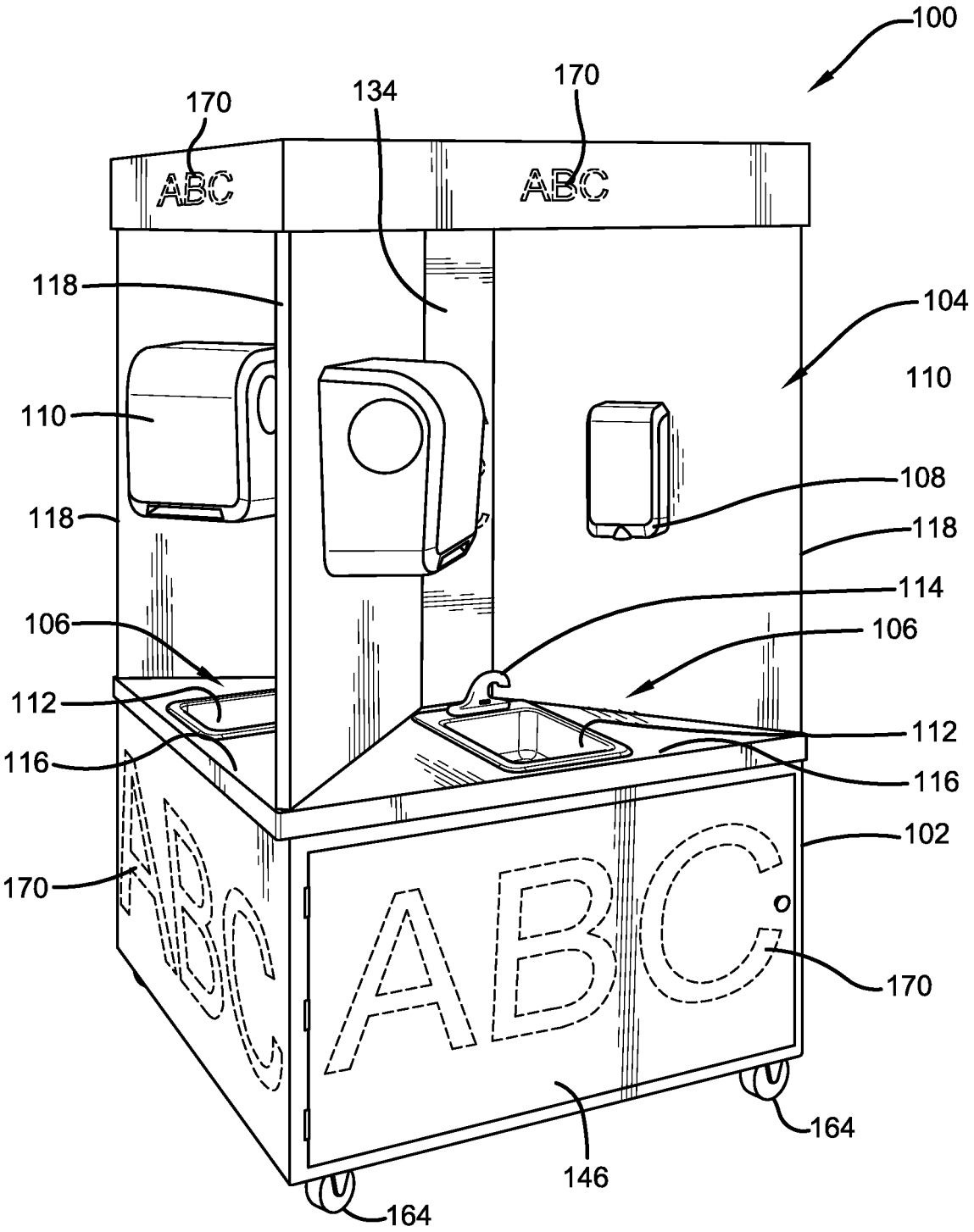
FIG. 1 is a perspective view of a hand wash station according to some embodiments of this invention.
Figure 2:
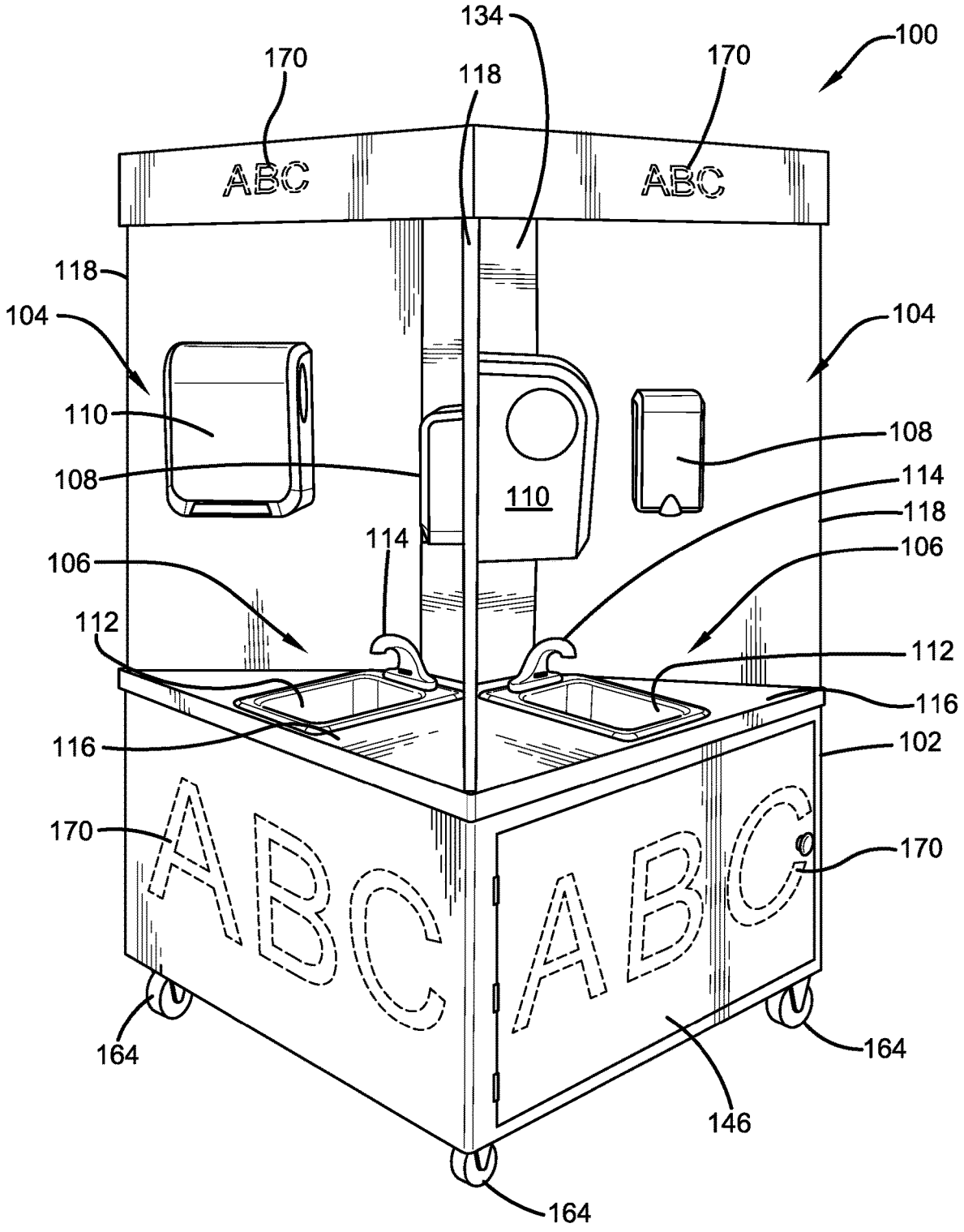
FIG. 2 is a corner view of the hand wash station.
Figure 3:
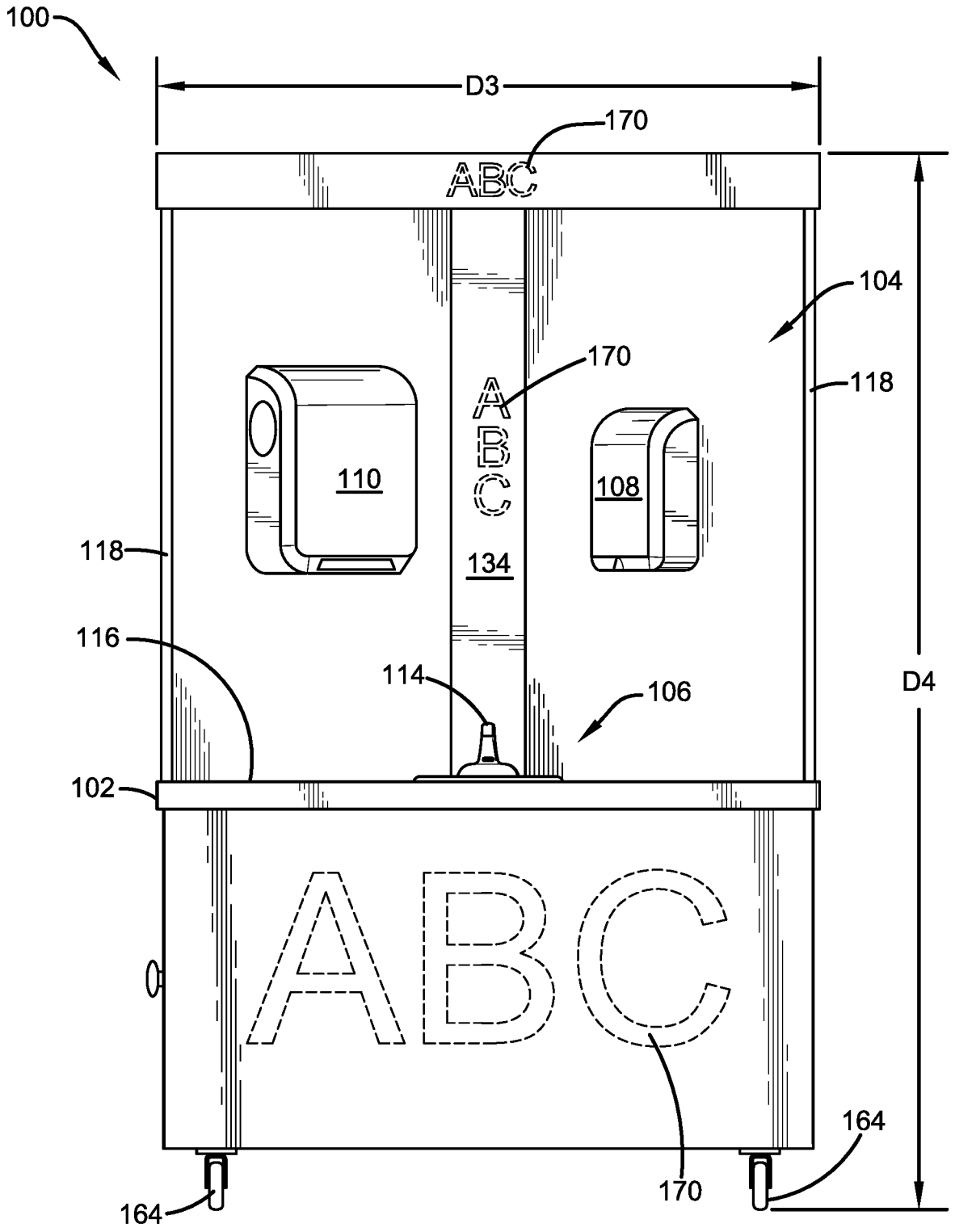
FIG. 3 is side view of the hand wash station.
Figure 4:
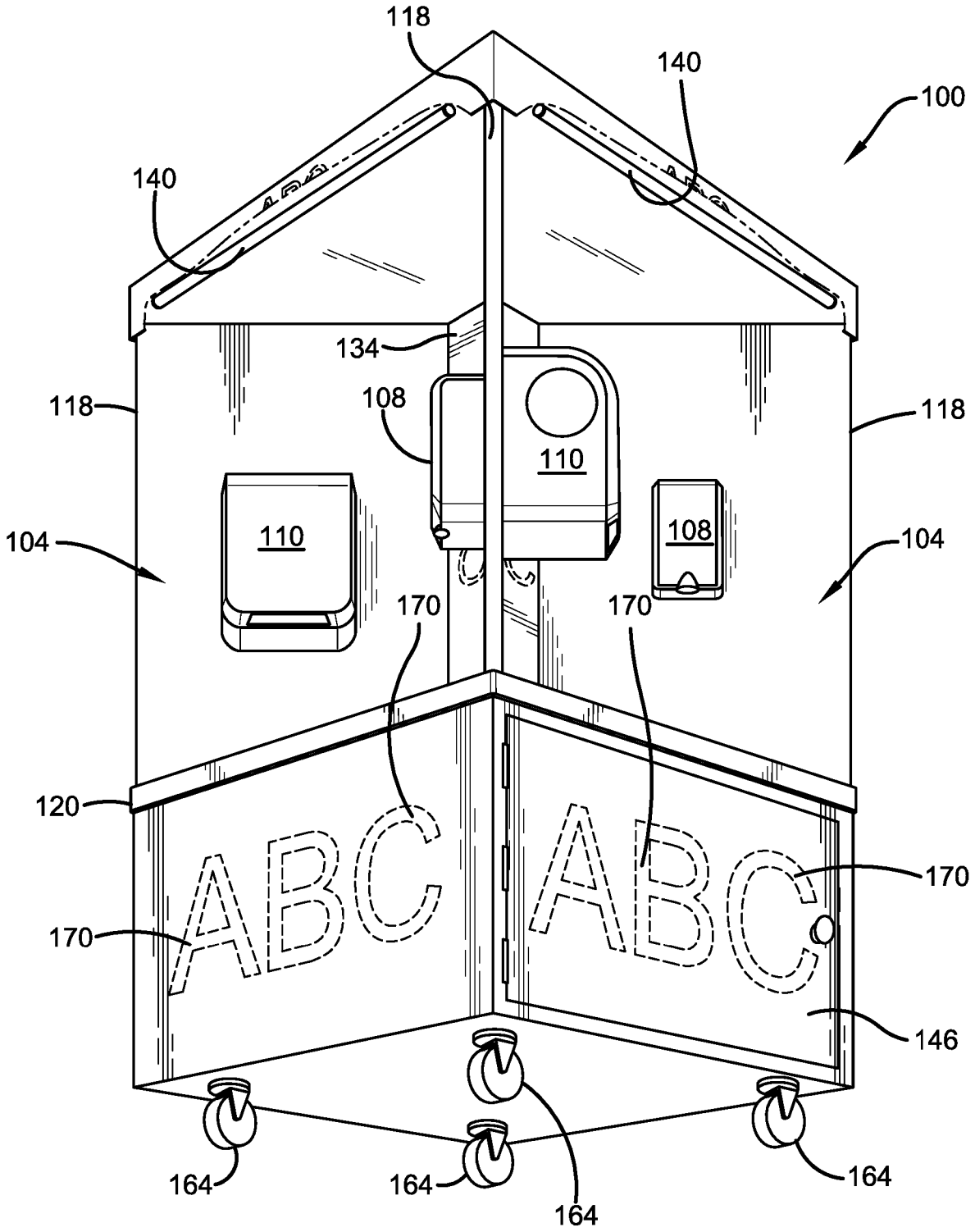
FIG. 4 is a bottom corner view of the hand wash station.
Figure 5:
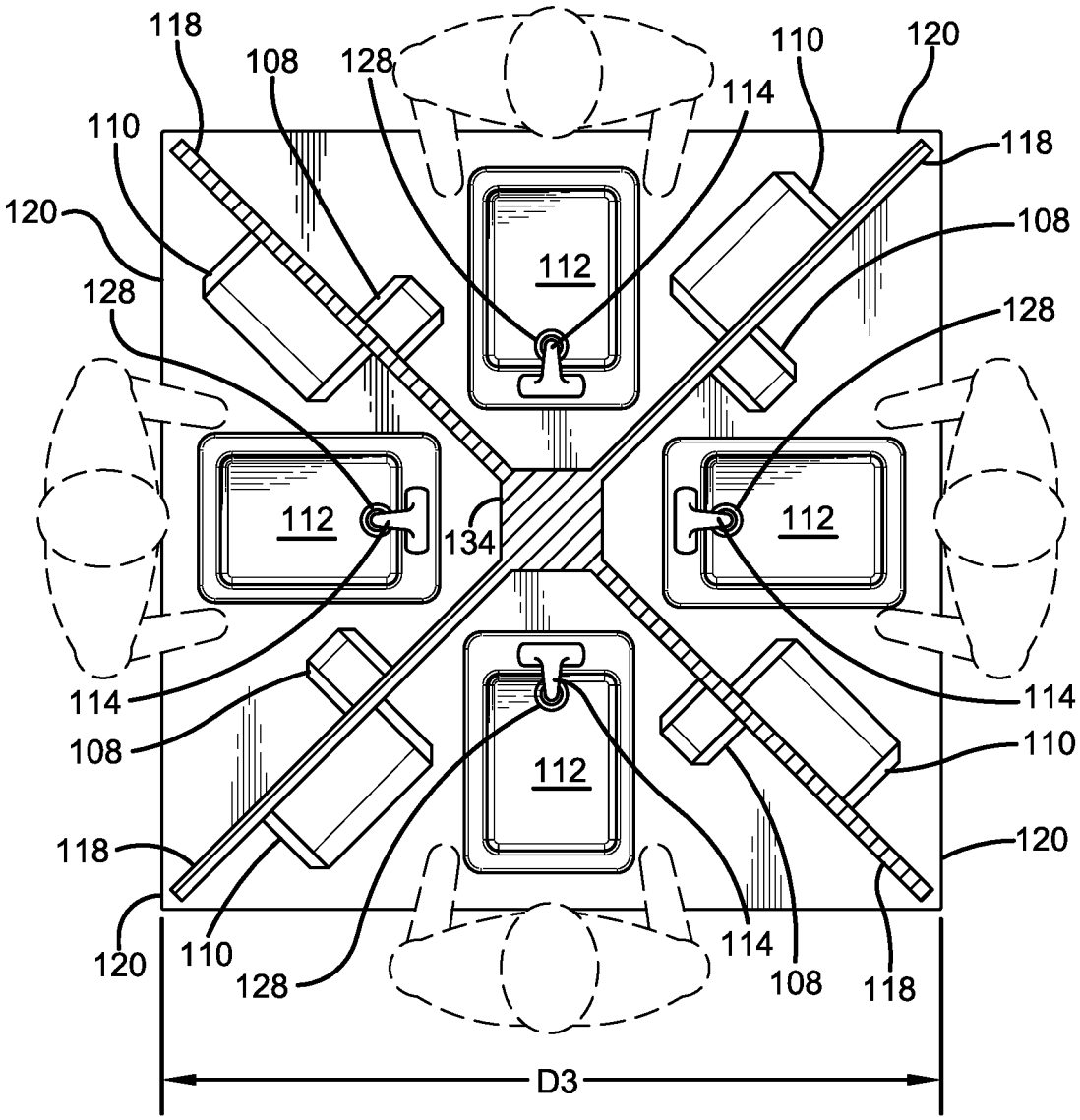
FIG. 5 is top view of the hand wash station with the roof removed for clarity.

Referring now to the drawings wherein the showings are for purposes of illustrating embodiments of the invention only and not for purposes of limiting the same, and wherein like reference numerals are understood to refer to like components, FIGS. 1-5 show a hand wash station 100 according to some embodiments of this invention. Hand wash station 100 may have a structural frame 102 that defines one or more wash areas 104. Four wash areas 104 are provided with hand wash station 100, as shown. Each wash area 104 may be supported to the structural frame 102 and have one or more implements used to wash the user's hands (users are shown with dashed lines in FIG. 5). The specific implements used may vary depending on what is required for a particular application. For the embodiments shown, each wash area 104 includes the following implements: a sink 106, one or more hand cleanser supply implements 108 (one shown) and one or more hand drying implements 110 (one shown). These implements will be discussed below.

With continuing reference to FIGS. 1-5, each sink 106 may be supported to a countertop 116 and may include a basin 112 with a drain 128 and a water supply implement 114 which may be a water faucet, as shown. Each sink 106 may be NSF certified. To minimize human contact, the water supply implement 114 may be an automatic no touch implement. In some embodiments, the water faucet 114 may provide water that can be temperature adjusted either by the user or automatically by a temperature control unit (discussed below). In other embodiments, not shown, one or more handles may be used by the user to control water amount and/or temperature from the water faucet 114. Both the sink basin 112 and the neighboring countertops 116 may be NSF certified and may be formed of stainless steel. The hand cleanser supply implement(s) 108 may be a soap dispenser and/or a sanitizer dispenser. To minimize human contact, each hand cleanser supply implement 108 may be an automatic no touch implement. The hand drying implement(s) 110 may be a paper towel dispenser and/or a hand dryer that outputs air to dry the user's hands. To minimize human contact, each hand drying implement 110 may be an automatic no touch implement.

Figure 6:
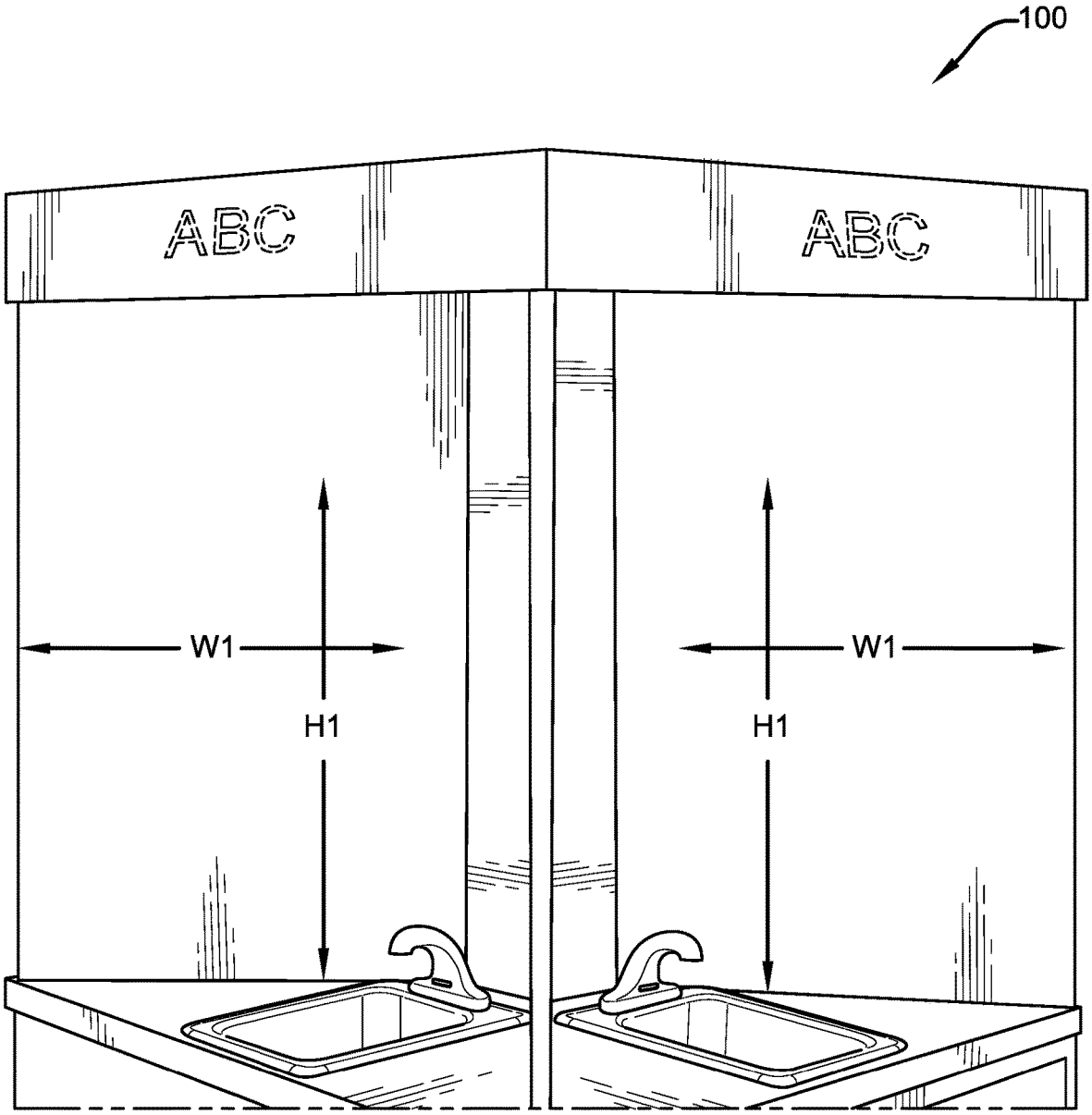
FIG. 6 is a close-up corner view of a portion of the hand wash station.

With reference now to FIGS. 1-6, to increase user protection, the frame 102 may include divider walls 118 supported to the structural frame 102 that separate the wash areas 104 from each other. Divider walls 118 may be NSF certified and may be formed of stainless steel. Divider walls 118 protect users at neighboring wash areas 104 from spreading germs onto each other. With reference specially to FIG. 6, each divider wall 118 may have a vertical height above the corresponding countertop 116 of H1 and a width perpendicular to the vertical height H1 of W1. Generally, the larger the area of each divider wall 118, the better its ability to protect users from the spread of germs. In some embodiments, each divider wall 118 has a minimum height H1 of at least 18 inches and a minimum width W1 of at least 18 inches. In other embodiments, each divider wall 118 has a minimum vertical height H1 of at least 30 inches and a minimum width W1 of at least 30 inches. To better protect users at one wash area 104 from the coughs and/or sneezes of users at neighboring wash areas 104, the minimum vertical height H1 may be at least 40 inches. This better protects users—given the varying heights of users. In some embodiments, shown in FIGS. 1 and 2, the divider walls 18 extend toward the outer corners of the hand wash station 100.

With reference now to FIGS. 1-8, each wash area 104 may be positioned on a side of the hand wash station 100. The hand wash stations 100 shown have a rectangular cross-sectional shape with four sides 120 (see FIG. 5) and a wash station 100 positioned on each of the four sides, labeled

Figure 7:
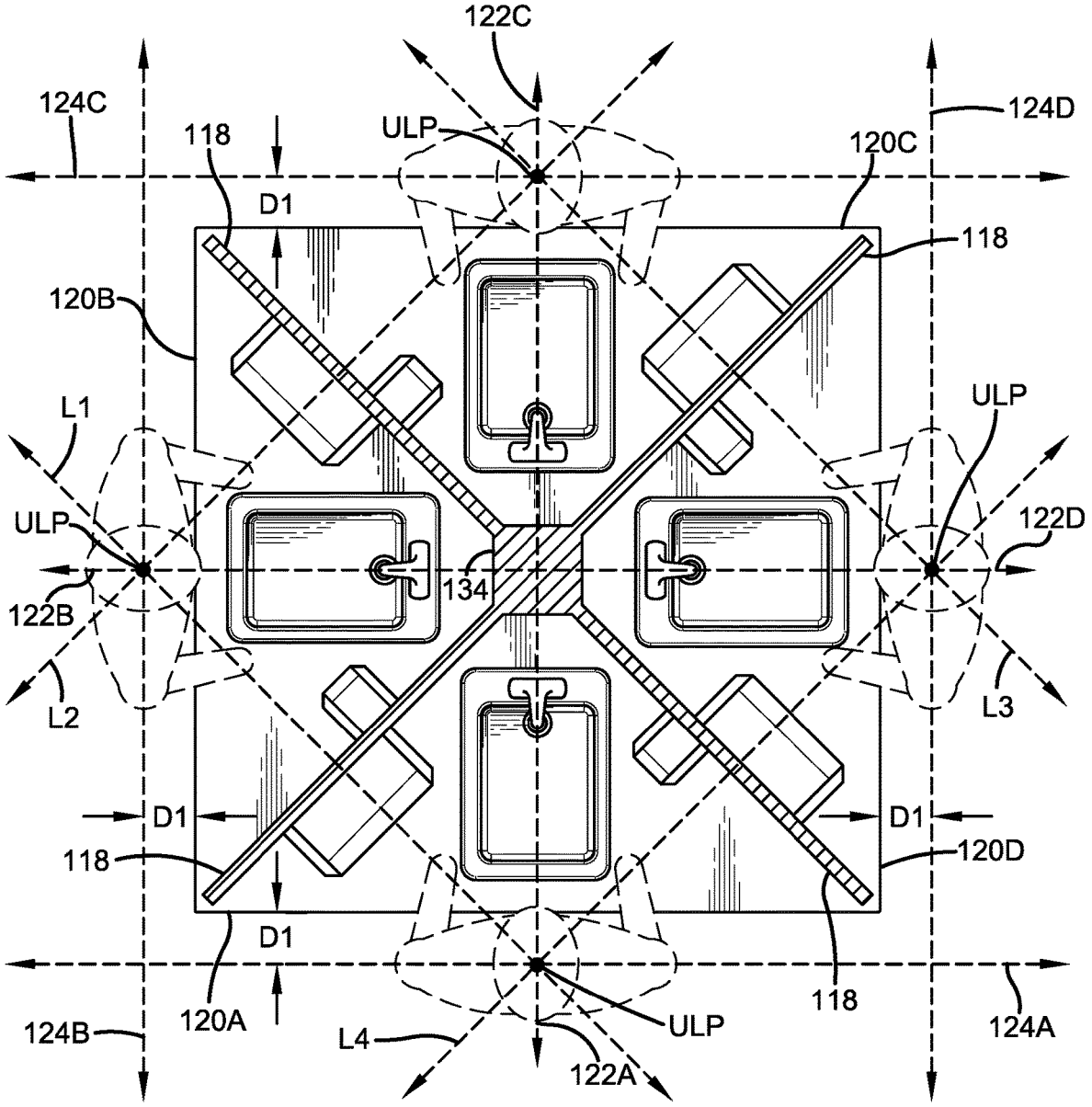
FIG. 7 is top view of the hand wash station with the roof removed for clarity showing user location points ULP for each wash area.
Figure 8:
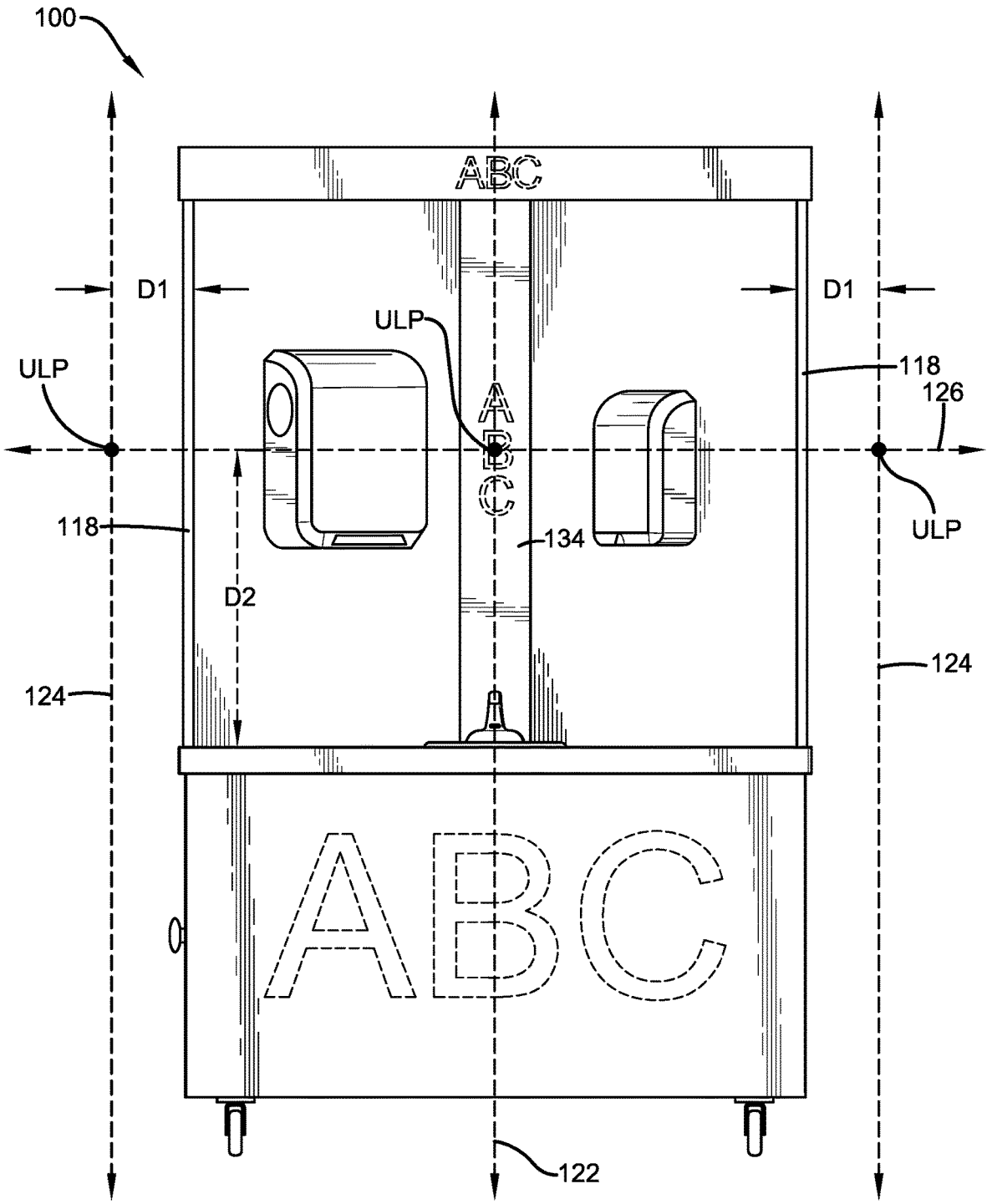
FIG. 8 is side view of the hand wash station showing user location points ULP.
Figure 9:
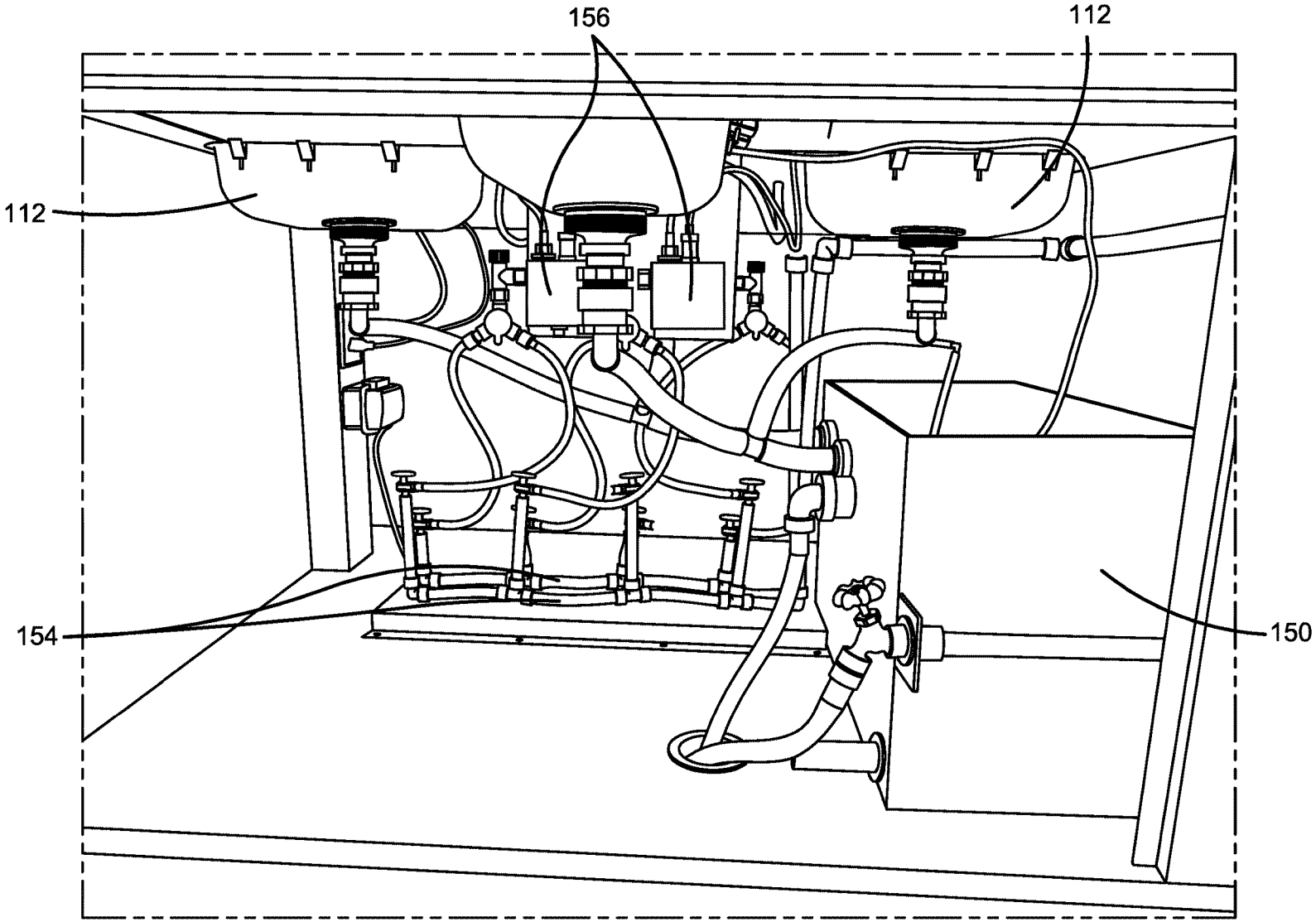
FIG. 9 is a side view with the housing panel open showing components within the housing including a grey water tank.
Figure 10:
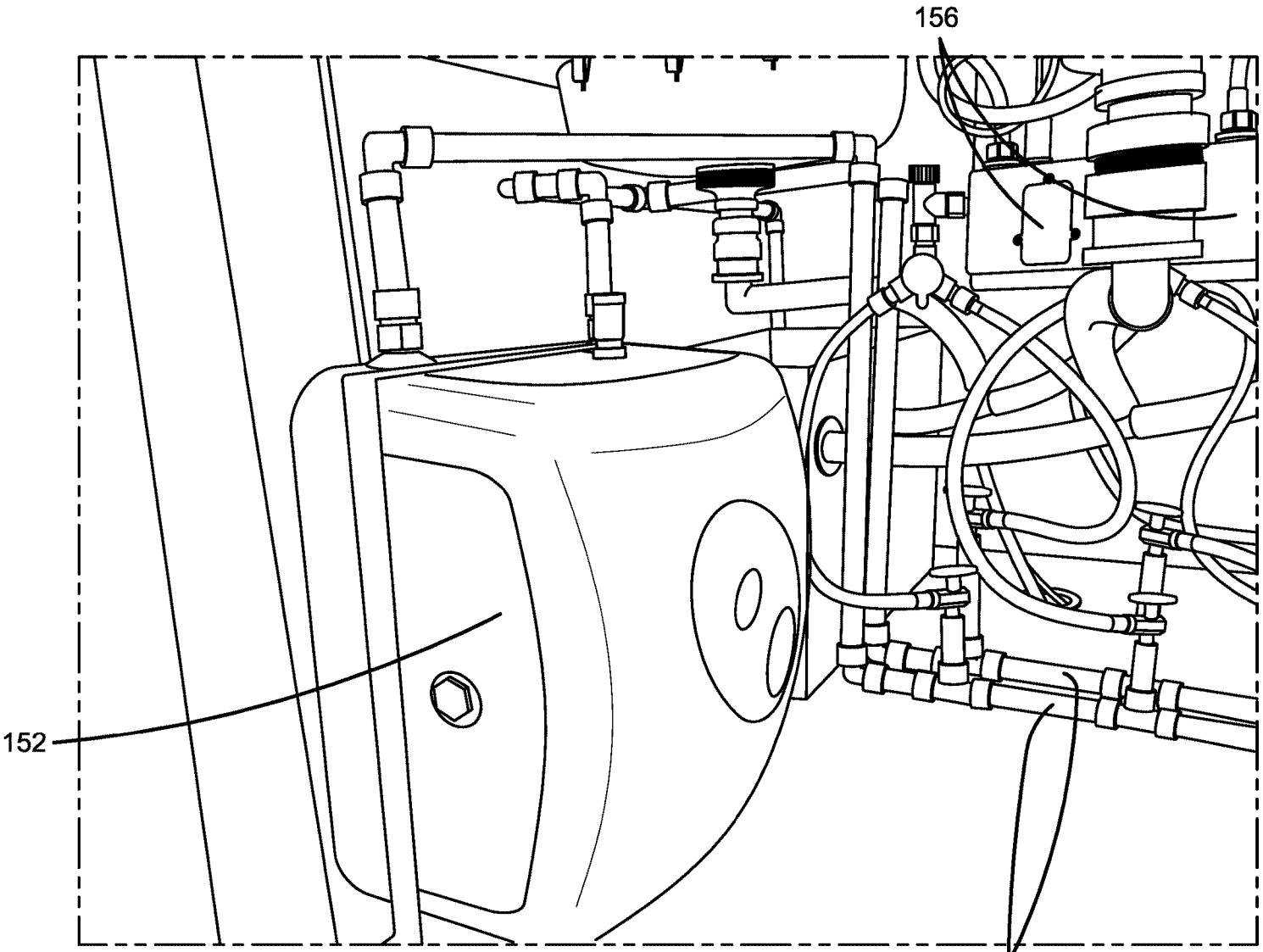
FIG. 10 is a side view with the housing panel open showing components within the housing including a water heater.
Figure 11:
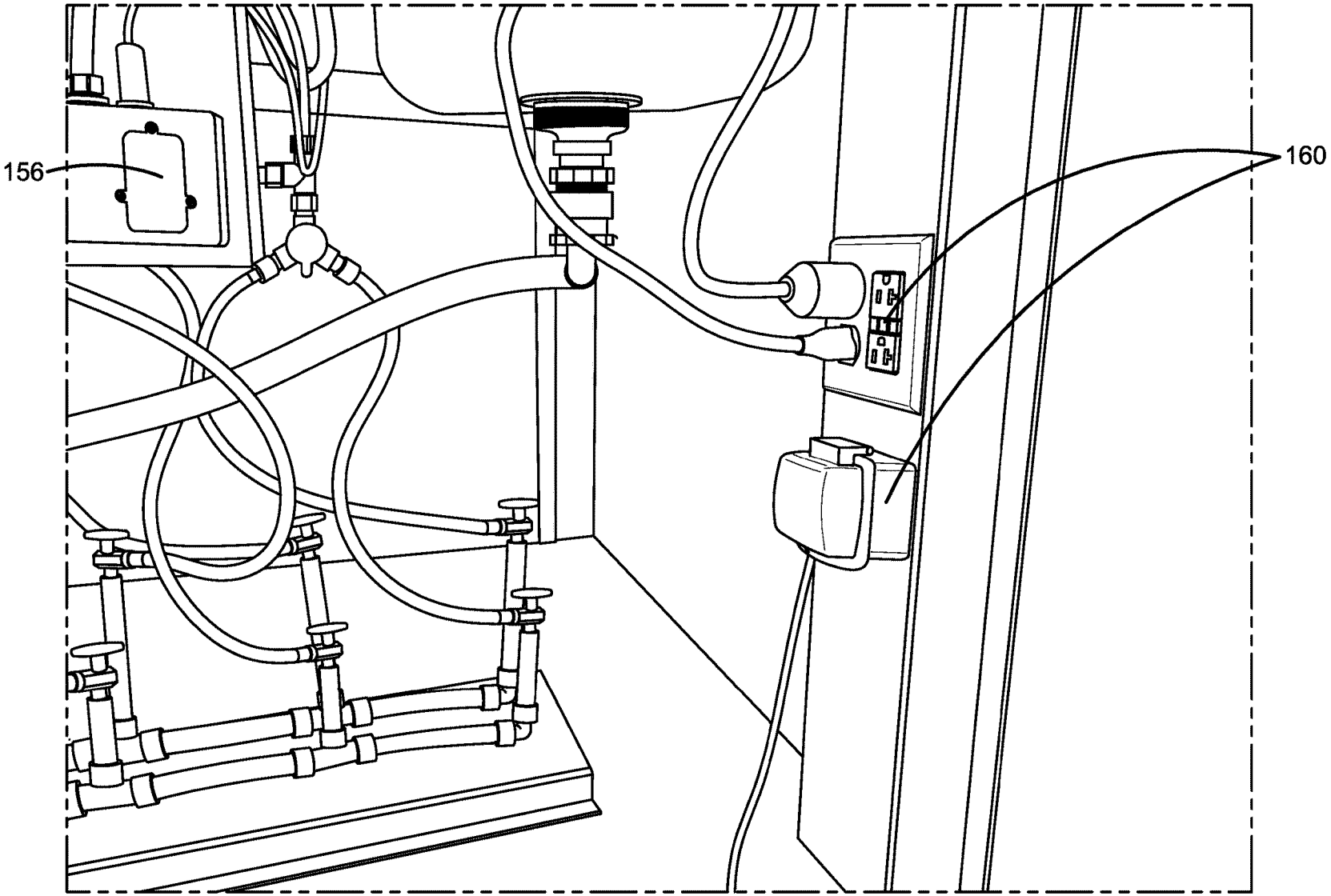
FIG. 11 is a side view with the housing panel open showing electrical components within the housing.

120A, 120B, 120C, 120D in FIG. 7. With reference specially to FIGS. 7-8, each wash area 120 defines a user location point ULP. Each user location point ULP is an estimate of the location of the mouth/nose area of a user. The precise location of a user's mouth/nose area will depend, of course, on the user's height. The user location point ULP is defined as a point that: A) lies on a first plane 122 (with added A, B, C and D to correspond with the given side in FIG. 7) that evenly and laterally bisects the corresponding side 120; B) lies on a second plane 124 (with added A, B, C and D to correspond with the given side in FIG. 7) that: 1) is parallel to the corresponding side 120; 2) is perpendicular to the first plane 122; and 3) is positioned a distance D1 exterior to a perimeter of the countertop 116 on the corresponding side; and C) lies on a third plane 126 that: 1) is perpendicular to the first plane 122; 2) is perpendicular to the second plane 124; and 3) is positioned vertically a distance D2 above the countertop 116 on the corresponding side 120. Completing the definition of the user location points ULP, distance D1 is 6 inches and distance D2 is 30 inches.

With reference now to FIGS. 6-8, in some embodiments, to enhance the protection of users at one wash area 120 from the coughs and/or sneezes of users at other wash areas 104, a first line L1 that intersects the user location point ULP on the first side 120A and the user location point ULP on the second side 120B passes through a divider wall 118; a second line L2 that intersects the user location point ULP on the second side 120B and the user location point ULP on the third side 120C passes through a divider wall 118; a third line L3 that intersects the user location point ULP on the third side 130C and the user location point ULP on the fourth side 120D passes through a divider wall 118; and a fourth line L4 that intersects the user location point ULP on the first side 120A and the user location point ULP on the fourth side 120D passes through a divider wall 118. Thus, each user is protected from the other users by at least one divider wall 118 or other surface of the hand wash station 100 (such as the central column 134, discussed further below).

With reference now to FIGS. 1-8, in some embodiments the divider walls 118 may also serve as support surfaces for the hand cleanser supply implement 108 and the hand drying implement 110, as shown. In some embodiments, the structural frame 102 may include a roof structure 130 defining a ceiling 132 for each wash area 104. In some embodiments, a light source 140 is provided for each wash area 104 to provide illumination for the users. In one embodiment, see FIG. 4, a light source 140 may be provided on the ceiling 132. The light source 140 can be of any type chosen with the sound judgment of a person of skill in the art. The light sources 140 shown are LED light bars. To minimize human contact, the light sources 140 may be automatic no touch lights. In other embodiments, the light sources 140 may remain on. In some embodiments, shown, to provide additional structural rigidity, the structural frame 102 may include a central column 134 to which the divider walls 118, the countertops 116 and the roof structure 130 attach. A housing 144 may be supported to the structural frame 102. The housing 144 may be positioned, as shown, at the lower portion of the hand wash station 100. The housing 144 may contain or house various supplies and/or tanks as will be discussed further below. The housing 144 may have one or more service panels 146 providing access to the components within the housing 144. The service panels 146 may be lockable to prevent unauthorized entry. While the dimensions of the hand wash station 100 can be any chosen with the sound judgment of a person of skill in the art, for the embodiments shown each side of the hand wash station 100, dimension D3, is 52 inches and the height of the hand wash station 100, dimension D4, is 84 inches.

With reference now to FIGS. 4-5 and 9-11, some optional components that may be provided within the housing 144 will be described. The sink basins 112 may drain into a grey water tank 150. A grey water pump, not visible, may be positioned within or nearby the tank 150 and pump the grey water to an appropriate grey water disposal. A water heater 152 may be used to provide heated water. Water supply piping 154 may be used to provide water to the sinks 106 and/or to the water heater 152. Temperature control units 156 may be used to provide water at an appropriate temperature to the sinks 106. Electrical components 160 may provide a connection to receive electricity from an outside source and connections that components on the hand wash station can attach to in order to receive electric power. In some embodiments, water is supplied from a local fresh water source. In other embodiments, an onboard fresh water holding container with a pump is used. In some embodiments, a grey water pump is not provided, and the grey water tank 150 simply holds the grey water until it can be emptied. The components used to supply and provide tanks for the hand wash station 100 can be any chosen with the sound judgment of a person of skill in the art.

As noted above and shown in FIGS. 5 and 7, the cross-sectional shape of the hand wash station 100 is rectangular, and ideally square. While the square shape is ideal, this invention is not limited to a rectangular shape. It can have any shape that includes at least three wash areas supported on non-coplanar sides of the hand wash station and one or more divider walls that separates the wash areas from each other. Depending on the arrangement of wash areas, a divider wall may separate more than two wash areas.

As shown in FIGS. 1-4 and 8, the hand wash station 100 may be mobile, meaning that it is designed to be easily movable from one location to another. For the embodiments shown, the mobility is provided by the wheels 164 attached to the bottom of the hand wash station 100. In another embodiment, not shown, forklift openings may be provided on the hand wash station 100 to provide mobility. In other embodiments, however, the hand wash station may not be mobile, meaning that it is designed to be fixed in place—such as to a surface below the hand wash station. The hand wash station 100 shown is intended for outdoor applications. In other embodiments, however, the hand wash station can be used indoors. In some embodiments, shown in FIGS. 1-4, 6 and 8, the hand wash station 100 may have one or more information and/or branding and/or graphic area(s) as indicated with reference 170.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the patent claims or the equivalents thereof. Further, the "invention" as that term is used in this document is what is claimed in the patent claims. The right to claim elements and/or sub-combinations that are disclosed herein as other inventions in other patent documents is hereby unconditionally reserved.

I claim:

1. A mobile hand wash station comprising:

a generally square cross-sectional shape having four sides defined as first, second, third and fourth non-coplanar sides;

a structural frame;

a first wash area supported to the structural frame and positioned on the first side;

a second wash area supported to the structural frame and positioned on the second side;

a third wash area supported to the structural frame and positioned on the third side;

a fourth wash area supported to the structural frame and positioned on the fourth side;

a first divider wall supported to the structural frame that separates the first and second wash areas from each other;

a second divider wall supported to the structural frame that separates the second and third wash areas from each other;

a third divider wall supported to the structural frame that separates the third and fourth wash areas from each other;

a fourth divider wall supported to the structural frame that separates the fourth and first wash areas from each other; and a roof structure supported to the structural frame and defining a ceiling for each wash area;

wherein:

A) each wash area includes: 1) a sink supported to a countertop and having: (a) a basin: and (b) a water supply implement; 2) a hand cleanser supply implement; and 3) a hand drying implement;

B) each divider wall has a minimum vertical height above the corresponding countertop of at least 40 inches and a minimum width perpendicular to the vertical height of at least 30 inches;

C) a portion of each divider wall contacts the roof structure;

D) each wash area defines a user location point that: 1) lies on a first plane that evenly and laterally bisects the corresponding side; 2) lies on a second plane that: (a) is parallel to the corresponding side; (b) is perpendicular to the first plane; and (c) is positioned 6 inches exterior to a perimeter of the countertop on the corresponding side; and 3) lies on a third plane that: (a) is perpendicular to the first plane; (b) is perpendicular to the second plane; and (c) is positioned vertically at 30 inches above the countertop on the corresponding side;

E) a first line that intersects the user location point on the first side and the user location point on the second side passes through the first divider wall;

F) a second line that intersects the user location point on the second side and the user location point on the third side passes through the second divider wall;

G) a third line that intersects the user location point on the third side and the user location point on the fourth side passes through the third divider wall; and H) a fourth line that intersects the user location point on the first side and the user location point on the fourth side passes through the fourth divider wall; and I) the mobile hand wash station is adapted to be easily movable from one location to another using wheels attached to the bottom of the mobile hand wash station.

2. The mobile hand wash station of claim 1 wherein:

each water supply implement is an automatic no touch implement;

each hand cleanser supply implement is an automatic no touch implement; and each hand drying implement is an automatic no touch implement.

3. The mobile hand wash station of claim 2 further comprising:

a light source for each wash area supported within each corresponding wash area; and wherein each light source is an automatic no touch light source.

4. The mobile hand wash station of claim 3 further comprising:

a housing supported to the structural frame; and a grey water tank positioned within the housing and adapted to receive drain water from drains positioned within each sink basin.

5. The mobile hand wash station of claim 4 further comprising:

a water heater positioned within the housing and adapted to provide heated water to each of the water supply implements.

6. A mobile hand wash station comprising:

a generally rectangular cross-sectional shape having four sides defined as first, second, third and fourth non-coplanar sides;

a structural frame;

a first wash area supported to the structural frame and positioned on the first side;

a second wash area supported to the structural frame and positioned on the second side;

a third wash area supported to the structural frame and positioned on the third side;

a fourth wash area supported to the structural frame and positioned on the fourth side;

a first divider wall supported to the structural frame that separates the first and second wash areas from each other;

a second divider wall supported to the structural frame that separates the second and third wash areas from each other;

a third divider wall supported to the structural frame that separates the third and fourth wash areas from each other;

a fourth divider wall supported to the structural frame that separates the fourth and first wash areas from each other; and a light source for each wash area supported within each corresponding wash area;

wherein:

A) each wash area includes: 1) a sink supported to a countertop and having: (a) a basin: (b) a water supply implement; 2) a hand cleanser supply implement; and 3) a hand drying implement;

B) each divider wall has a minimum vertical height above the corresponding countertop of at least 40 inches and a minimum width perpendicular to the vertical height of at least 30 inches;

C) each wash area defines a user location point that: 1) lies on a first plane that evenly and laterally bisects the corresponding side; 2) lies on a second plane that: (a) is parallel to the corresponding side; (b) is perpendicular to the first plane; and (c) is positioned 6 inches exterior to a perimeter of the countertop on the corresponding side; and 3) lies on a third plane that: (a) is perpendicular to the first plane; (b) is perpendicular to the second plane; and (c) is positioned vertically at 30 inches above the countertop on the corresponding side;

D) a first line that intersects the user location point on the first side and the user location point on the second side passes through the first divider wall;

E) a second line that intersects the user location point on the second side and the user location point on the third side passes through the second divider wall;

F) a third line that intersects the user location point on the third side and the user location point on the fourth side passes through the third divider wall; and G) a fourth line that intersects the user location point on the first side and the user location point on the fourth side passes through the fourth divider wall; and H) the mobile hand wash station is adapted to be easily movable from one location to another.

7. The mobile hand wash station of claim 6 further comprising:

a roof structure supported to the structural frame and defining a ceiling for each wash area; and wherein a portion of each divider wall contacts the roof structure.

8. The mobile hand wash station of claim 6 wherein:

each water supply implement is an automatic no touch implement;

each hand cleanser supply implement is an automatic no touch implement; and each hand drying implement is an automatic no touch implement.

9. The mobile hand wash station of claim 6 wherein:

each light source is an automatic no touch light source.

10. The mobile hand wash station of claim 6 further comprising:

a housing supported to the structural frame; and a grey water tank positioned within the housing and adapted to receive drain water from drains positioned within each sink basin.

11. The mobile hand wash station of claim 6 further comprising:

a housing supported to the structural frame; and a water heater positioned within the housing and adapted to provide heated water to each of the water supply implements.

12. The mobile hand wash station of claim 6 wherein for each wash area:

the hand cleanser supply implement is supported to the divider wall on a first side of the corresponding sink; and the hand drying implement is supported to the divider wall on a second side, opposite the first side, of the corresponding sink.

13. A mobile hand wash station comprising:

a generally rectangular cross-sectional shape having four sides defined as first, second, third and fourth non-coplanar sides;

a structural frame;

a first wash area supported to the structural frame and positioned on the first side;

a second wash area supported to the structural frame and positioned on the second side;

a third wash area supported to the structural frame and positioned on the third side;

a fourth wash area supported to the structural frame and positioned on the fourth side;

a first divider wall supported to the structural frame that separates the first and second wash areas from each other;

a second divider wall supported to the structural frame that separates the second and third wash areas from each other;

a third divider wall supported to the structural frame that separates the third and fourth wash areas from each other; and a fourth divider wall supported to the structural frame that separates the fourth and first wash areas from each other;

wherein:

A) each wash area includes: 1) a sink supported to a countertop and having: (a) a basin: and (b) a water supply implement; 2) a hand cleanser supply implement; and 3) a hand drying implement;

B) each divider wall has a minimum vertical height above the corresponding countertop of at least 40 inches and a minimum width perpendicular to the vertical height of at least 30 inches; and C) the mobile hand wash station is adapted to be easily movable from one location to another.

14. The mobile hand wash station of claim 13 further comprising:

a roof structure supported to the structural frame and defining a ceiling for each wash area; and wherein a portion of each divider wall contacts the roof structure.

15. The mobile hand wash station of claim 13 wherein:

each water supply implement is an automatic no touch implement;

each hand cleanser supply implement is an automatic no touch implement; and each hand drying implement is an automatic no touch implement.

16. The mobile hand wash station of claim 13 further comprising:

a light source for each wash area supported within each corresponding wash area; and wherein each light source is an automatic no touch light source.

17. The mobile hand wash station of claim 13 further comprising:

a housing supported to the structural frame; and a grey water tank positioned within the housing and adapted to receive drain water from drains positioned within each sink basin.

18. The mobile hand wash station of claim 13 further comprising:

a housing supported to the structural frame; and a water heater positioned within the housing and adapted to provide heated water to each of the water supply implements.

19. The mobile hand wash station of claim 13 wherein for each wash area:

the hand cleanser supply implement is supported to the divider wall on a first side of the corresponding sink; and the hand drying implement is supported to the divider wall on a second side, opposite the first side, of the corresponding sink.

20. The mobile hand wash station of claim 13 wherein:

each wash area defines a user location point that: 1) lies on a first plane that evenly and laterally bisects the corresponding side; 2) lies on a second plane that: (a) is parallel to the corresponding side; (b) is perpendicular to the first plane; and (c) is positioned 6 inches exterior to a perimeter of the countertop on the corresponding side; and 3) lies on a third plane that: (a) is perpendicular to the first plane; (b) is perpendicular to the second plane; and (c) is positioned vertically at 30 inches above the countertop on the corresponding side;

a first line that intersects the user location point on the first side and the user location point on the second side passes through the first divider wall;

a second line that intersects the user location point on the second side and the user location point on the third side passes through the second divider wall;

a third line that intersects the user location point on the third side and the user location point on the fourth side passes through the third divider wall; and a fourth line that intersects the user location point on the first side and the user location point on the fourth side passes through the fourth divider wall.

* * * * *